US008091983B2

(12) United States Patent
Xie et al.

(10) Patent No.: US 8,091,983 B2
(45) **Date of Patent: *Jan. 10, 2012**

(54) JET DIRECTIONALITY CONTROL USING PRINTHEAD NOZZLE

(75) Inventors: Yonglin Xie, Pittsford, NY (US); Carolyn R. Ellinger, Rochester, NY (US); Qing Yang, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 302 days.

This patent is subject to a terminal disclaimer.

(21) Appl. No.: 12/431,818

(22) Filed: Apr. 29, 2009

(65) Prior Publication Data

US 2010/0277529 A1 Nov. 4, 2010

(51) Int. Cl.
*B41J 2/14* (2006.01)
*B41J 2/16* (2006.01)

(52) U.S. Cl. ..... 347/47; 347/77

(58) Field of Classification Search ..... 347/9–12, 347/40–44, 47, 73–82, 15
See application file for complete search history.

(56) References Cited

U.S. PATENT DOCUMENTS

| | | | | |
|---|---|---|---|---|
| 3,373,437 | A | 3/1968 | Sweet et al. | |
| 3,878,519 | A | 4/1975 | Eaton | |
| 3,893,623 | A | 7/1975 | Toupin | |
| 4,638,328 | A | 1/1987 | Drake et al. | |
| 5,581,283 | A | 12/1996 | Rogers | |
| 6,079,821 | A | 6/2000 | Chwalek et al. | |
| 6,155,670 | A * | 12/2000 | Weber et al. | 347/43 |
| 6,457,807 | B1 | 10/2002 | Hawkins et al. | |
| 6,474,781 | B1 | 11/2002 | Jeanmaire | |
| 6,478,414 | B2 | 11/2002 | Jeanmaire | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 2010/0277552 | A1 * | 11/2010 | Xie et al. | 347/77 |

* cited by examiner

*Primary Examiner* — Thinh Nguyen

(74) *Attorney, Agent, or Firm* — William R. Zimmerli

(57) ABSTRACT

A method of printing and an apparatus for controlling the directionality of liquid emitted from nozzles of a printhead are provided. Example embodiments of the apparatus include directionality control of liquid jets or liquid drops using a liquid jet directionality control mechanism. Example embodiments of the liquid jet directionality control mechanism include asymmetric energy application device configurations, nozzle geometry configurations, liquid delivery channel geometry configurations, or combinations of these configurations.

7 Claims, 12 Drawing Sheets

JET DIRECTIONALITY CONTROL USING PRINTHEAD NOZZLE

CROSS REFERENCE TO RELATED APPLICATIONS

Reference is made to commonly-assigned, U.S. patent applications Ser. No. 12/431,810, entitled "PRINTHEAD CONFIGURATION TO CONTROL JET DIRECTIONALITY" and Ser. No. 12/431,826, entitled "JET DIRECTIONALITY CONTROL USING PRINTHEAD DELIVERY CHANNEL."

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, inkjet printing is accomplished by one of two technologies referred to as "drop-on-demand" and "continuous" inkjet printing. In both, liquid, such as ink, is fed through channels formed in a print head. Each channel includes a nozzle from which droplets are selectively extruded and deposited upon a recording surface.

Drop on demand printing only provides drops (often referred to a "print drops") for impact upon a print media. Selective activation of an actuator causes the formation and ejection of a drop that strikes the print media. The formation of printed images is achieved by controlling the individual formation of drops. Typically, one of two types of actuators is used in drop on demand printing—heat actuators and piezoelectric actuators. With heat actuators, a heater, placed at a convenient location adjacent to the nozzle, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties causing a wall of a liquid chamber adjacent to a nozzle to be displaced, thereby producing a pumping action that causes an ink droplet to be expelled.

Continuous inkjet printing uses a pressurized liquid source that produces a stream of drops some of which are selected to contact a print media (often referred to a "print drops") while other are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

Drop placement accuracy of print drops is critical in order to maintain image quality. As such, there is a continuing need to improve drop placement accuracy in these types of printing systems.

SUMMARY OF THE INVENTION

The present invention is directed at controlling the directionality of liquid emitted from nozzles. Example embodiments of the present invention include directionality control of liquid jets or liquid drops using a liquid jet directionality control mechanism. Example embodiments of the liquid jet directionality control mechanism include asymmetric energy application device configurations, nozzle geometry configurations, liquid delivery channel geometry configurations, or combinations of these configurations.

According to one feature of the present invention, a printhead includes a first nozzle and a second nozzle spaced apart from the first nozzle. A liquid delivery channel is in liquid communication with the first nozzle and the second nozzle to provide liquid that is under pressure sufficient to cause a first liquid jet to be emitted from the first nozzle at a first angle and a second liquid jet to be emitted from the second nozzle at a second angle. The first angle and the second angle are nonparallel relative to each other. A drop forming mechanism is configured to from large volume drops and small volume drops from the first liquid jet emitted from the first nozzle and the second liquid jet emitted from the second nozzle. A liquid jet directionality control mechanism is configured to control the first angle of the first liquid jet and the second angle of the second liquid jet relative to each other such that large volume drops formed from the first liquid jet and large volume drops formed from the second liquid jet contact each other or coalesce while the small volume drops formed from the first liquid jet and small volume drops formed from the second liquid jet do not contact each other or coalesce. The liquid jet directionality control mechanism can be associated with, for example, located in or near, the first nozzle, the second nozzle, the liquid delivery channel. Alternatively, the liquid jet directionality control mechanism can be associated with combinations of the first nozzle, the second nozzle, and the liquid delivery channel.

According to another feature of the present invention, a printhead includes a nozzle cluster including a first nozzle and a second nozzle spaced apart from the first nozzle, the first and second nozzles having a nozzle geometry. A liquid delivery channel is in liquid communication with the nozzle cluster to provide liquid that is under pressure sufficient to cause a first liquid jet to be emitted from the first nozzle at a first angle and a second liquid jet to be emitted from the second nozzle, the first angle and the second angle being nonparallel relative to each other. A drop forming mechanism is configured to from large volume drops and small volume drops from the first liquid jet emitted from the first nozzle and the second liquid jet emitted from the second nozzle. The nozzle geometry of the first nozzle and the second nozzle is shaped to control the first angle of the first liquid jet and the second angle of the second liquid jet relative to each other such that large volume drops formed from the first liquid jet and large volume drops formed from the second liquid jet contact each other or coalesce while the small volume drops formed from the first liquid jet and small volume drops formed from the second liquid jet do not contact each other or coalesce.

According to another feature of the present invention, a method of printing includes providing a nozzle cluster including a first nozzle and a second nozzle spaced apart from the first nozzle, the first and second nozzles having a nozzle geometry; providing liquid under pressure sufficient to cause a first liquid jet to be emitted from the first nozzle at a first angle and a second liquid jet to be emitted from the second nozzle at a second angle, the first angle and the second angle being nonparallel relative to each other; forming large volume drops and small volume drops from the first liquid jet emitted from the first nozzle and the second liquid jet emitted from the second nozzle by actuating a drop forming mechanism; and controlling the first angle of the first liquid jet and the second angle of the second liquid jet relative to each other such that large volume drops formed from the first liquid jet and large volume drops formed from the second liquid jet contact each other or coalesce while the small volume drops formed from the first liquid jet and small volume drops formed from the second liquid jet do not contact each other or coalesce using the shape of the nozzle geometry of the first nozzle and the second nozzle.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
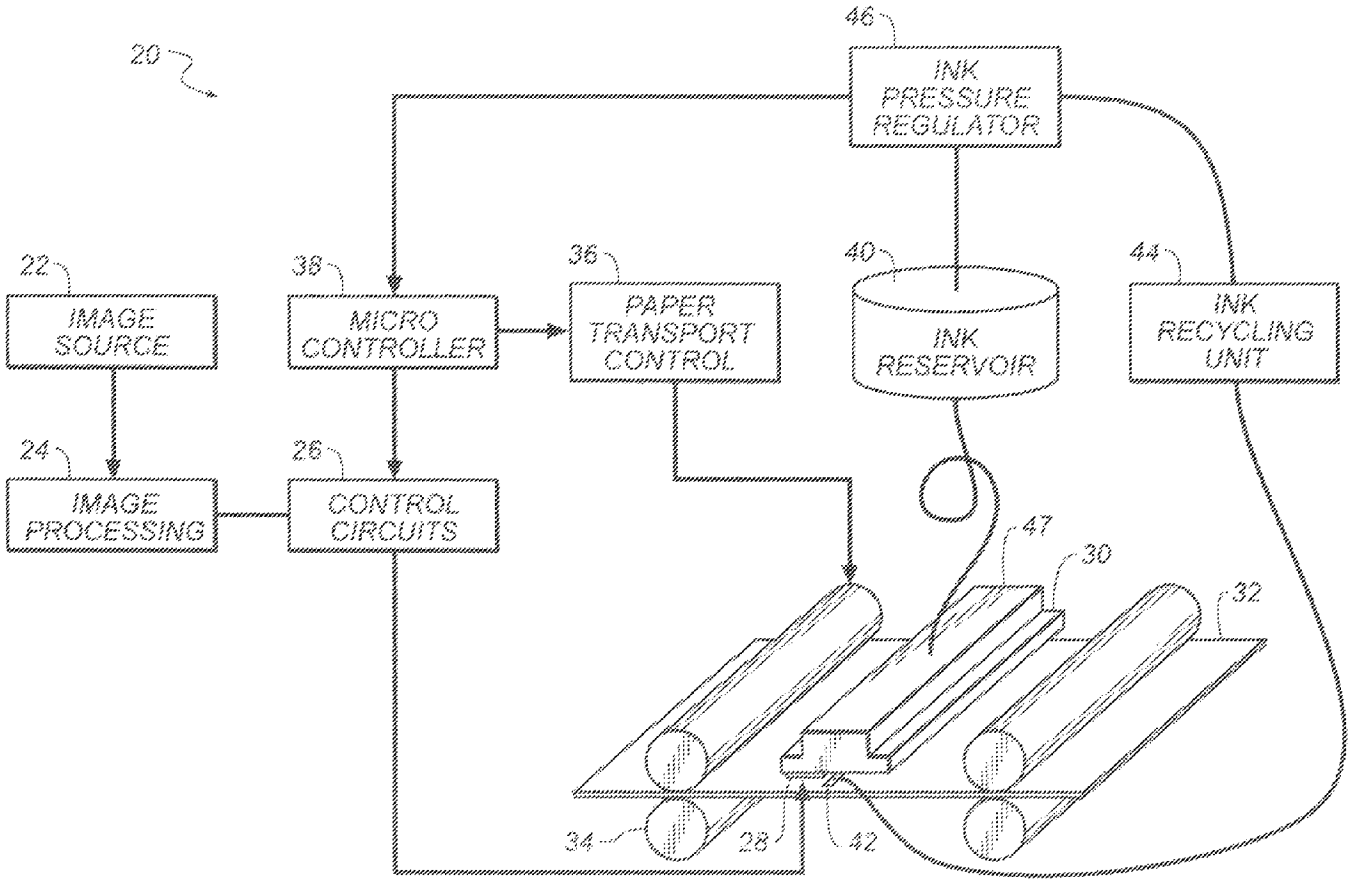
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
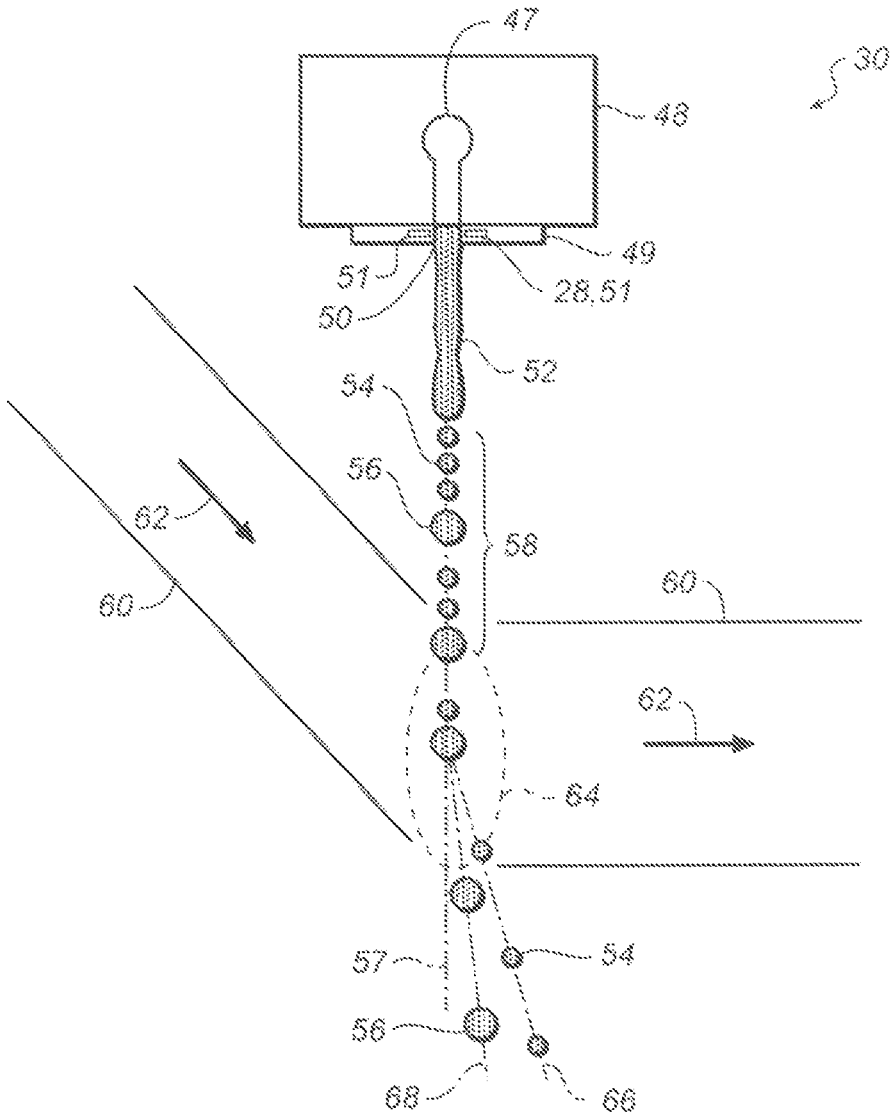
FIG. 2 is a schematic view of an example embodiment of a continuous printhead made in accordance with the present invention.
Figure 3:
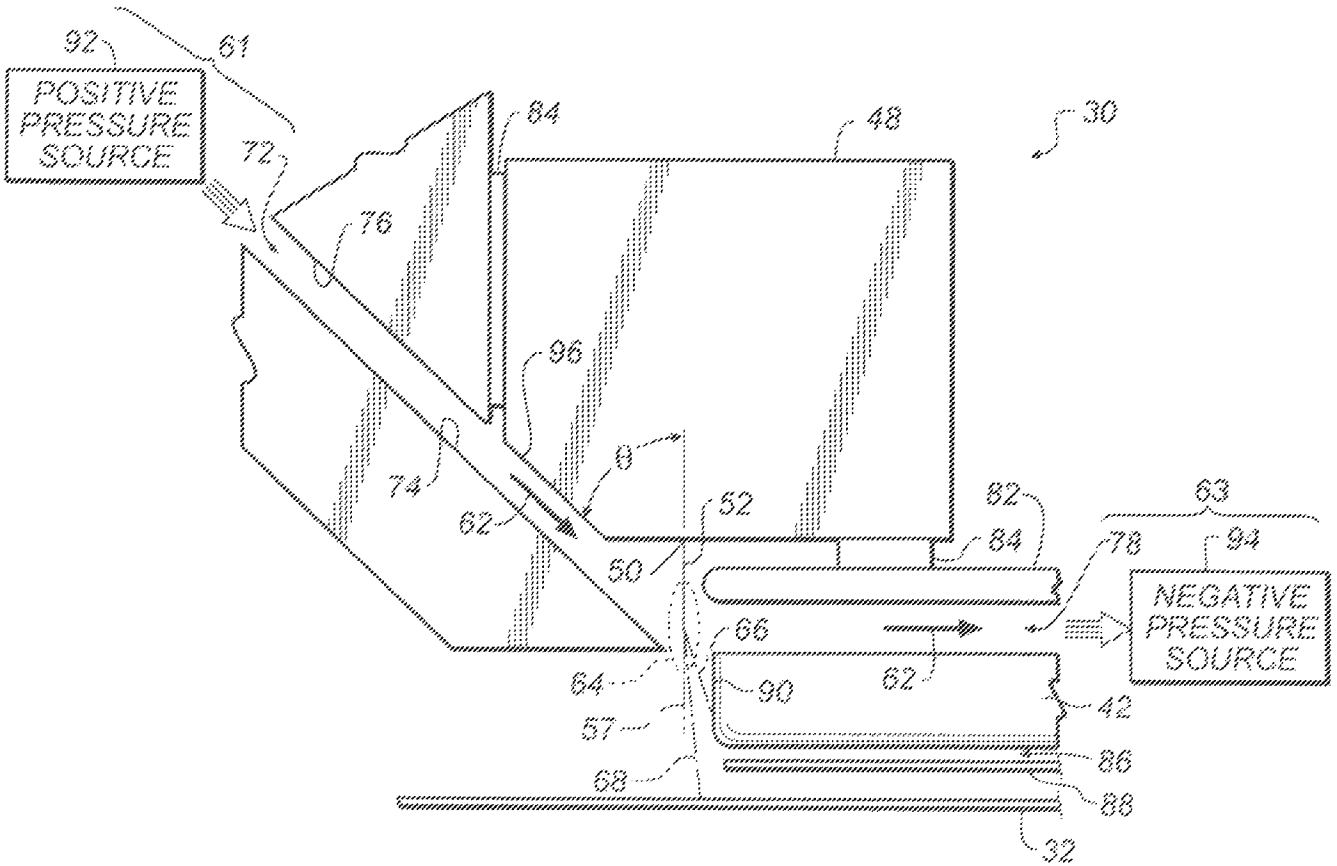
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4A:
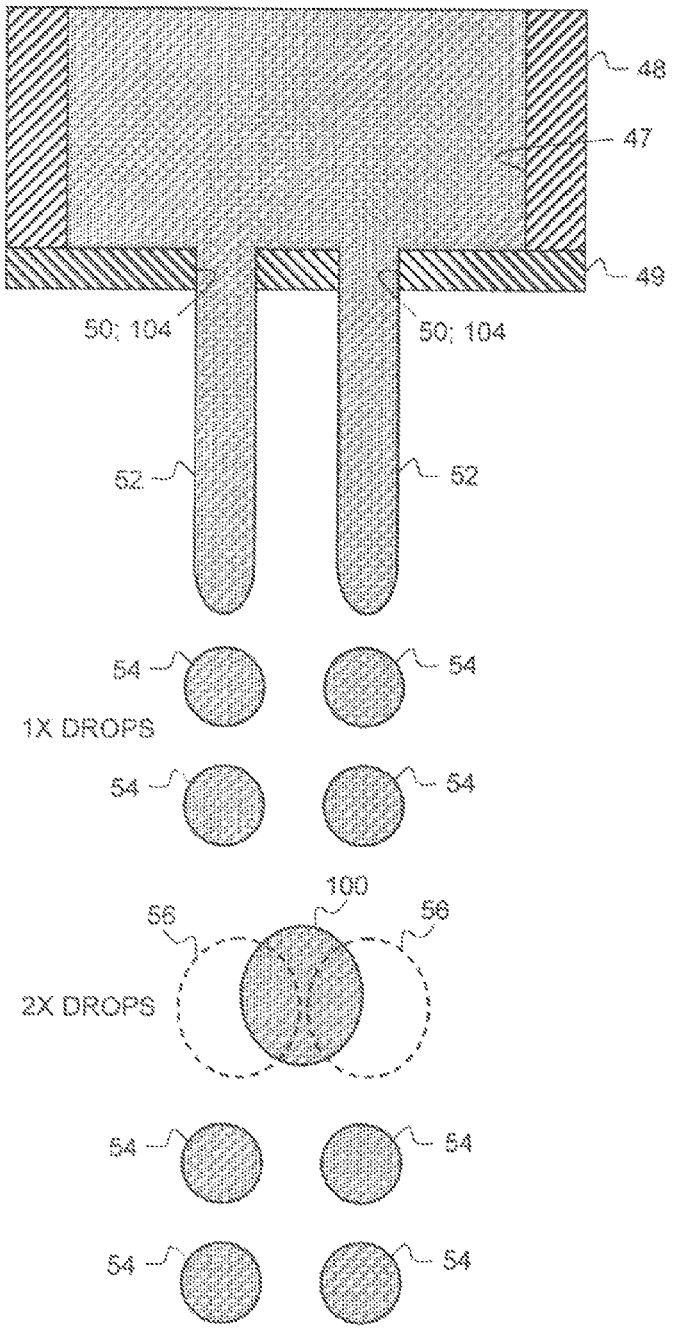
FIG. 4A is a partial schematic view of an example embodiment of a printhead made in accordance with the present invention.

Referring to FIG. 4A, a partial schematic view of an example embodiment of a jetting module of a printhead made in accordance with the present invention is shown. Jetting module 48 includes nozzle plate 49 and liquid delivery channel 47. Nozzle plate 49 includes two nozzles 50 which can be referred to as a nozzle cluster 104. Liquid is emitted under pressure through each nozzle 50 of the array to form filaments of liquid 52 (often referred to a liquid jets). In FIG. 4A, the array or plurality of nozzles extends to the left side and right side of the figure.

Jetting module 48 includes a drop forming device 28, shown in FIG. 2, that, when selectively activated, perturbs each filament of liquid 52 to induce portions of each filament to breakoff from the filament and coalesce to form small drops 54 and large drops 56. As shown in FIG. 4A, small drops 54 have a 1× drop size while large drops 56 have a 2× drop size. Nozzles 50 are positioned close enough relative to each other such that large drops 56 contact each other and coalesce forming a combined large drop 100 that has a 4× (2 times 2×) drop size. Other drop sizes are permitted and typically depend on the specific application contemplated. Printheads like this are known and have been described in U.S. Pat. No. 6,474,781, issued to Jeanmaire, on Nov. 5, 2002.

Figure 4B:
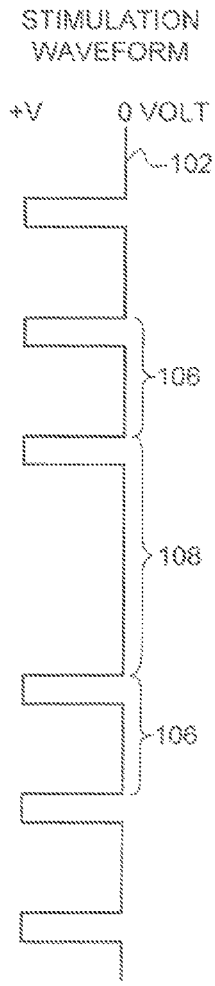
FIG. 4B is a schematic view of an example embodiment of a drop forming device stimulation waveform made in accordance with the present invention.

Referring to FIG. 4B, an example embodiment of a drop forming device stimulation waveform 102 is shown. Waveform 102 is provided by controller 38 to individual drop forming devices 28, for example, heaters, associated with nozzles 50. A high frequency of activation 106 of drop forming device 28 results in small drops 54, while a low frequency of activation 108 of drop forming device 28 results in large drops 56. These types of activation waveforms are known and have been described in U.S. Pat. No. 6,474,781, issued to Jeanmaire, on Nov. 5, 2002.

As described in FIGS. 4A and 4B, combined large drop 100 is 4 times the size of small drop 54. As such, the window for drop deflection can be maximized while drop throw distances (the distance the drop travels from the jetting module 48 to the recording medium 32) are reduced resulting in improved drop placement accuracy. In the example embodiment of the printing system described above, reduced gas flow velocities and simpler activation waveforms can be implemented when using the present invention. As a result, the present invention can reduce the complexity of the printing system and improve drop placement accuracy.

Figure 5:
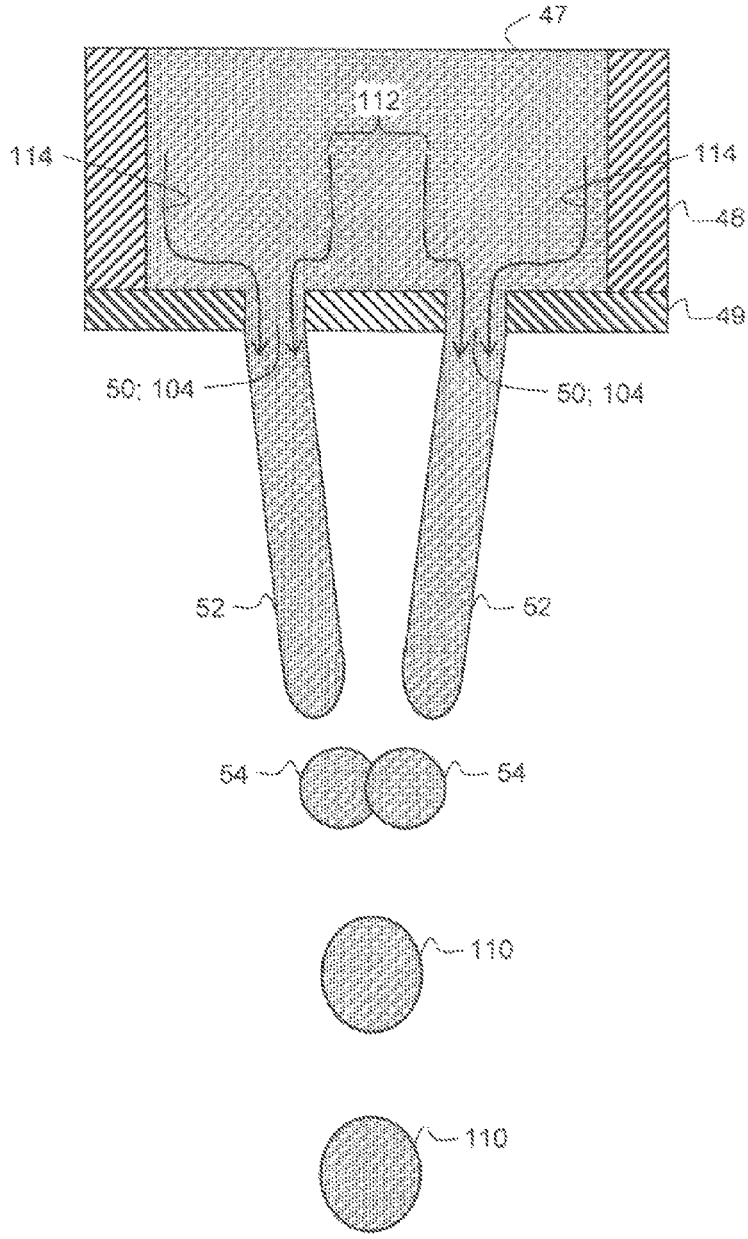
FIG. 5 is a schematic view of a problem solved by the present invention.

Referring to FIG. 5, experimental research and testing by the inventors of the present invention has determined that, under certain circumstances during operation, small drops 54 can be caused to contact each other and coalesce to form a combined small drop 110. Typically, this happened when nozzles 50 were positioned close enough to each other such that, when large drops 56 were formed from nozzles 50, large drops 56 contacted each other and coalesced without being influenced by an outside source. During experimental testing, this condition occurred when there is no jet directionality (or angle) control, for example, when there was no actuation of drop forming device 28 which caused the liquid jets to merge or when drop actuation was symmetric about the nozzle (for example, a heater positioned symmetrically around a nozzle) which caused the drops to break off from the jets and then merge. As shown in FIG. 5, when this condition occurs, the size ratio (2 to 1) of combined large drop 100 to combined small drop 110 is reduced when compared to the size ratio (4 to 1) of combined large drop 100 to small drop 54 which narrows the window for drop deflection, increases drop throw distances, and reduces the likelihood of maintaining drop placement accuracy.

It is believed that this condition is caused by an asymmetric lateral flow characteristic (represented by arrows 112 and 114) present in the liquid in liquid delivery channel 47. The liquid entering nozzles 50 from outer regions of the liquid delivery channel (the left side of the figure and the right side of the figure as shown in FIG. 5) has a stronger lateral flow component (represented by arrow 114) when compared to the lateral flow component (represented by arrows 112) of liquid entering nozzles 50 from the inner regions of the liquid delivery channel 47 (the center area of the figure as shown in FIG. 5). As the stronger lateral flow components are created in outer regions of the liquid delivery channel, the liquid filaments 52 are caused to be angled slightly toward each other when the liquid filaments 52 are emitted through nozzles 50. This causes the drop trajectory of small drops 54 to be nonparallel relative to each other and ultimately results in small drops 54 contacting each other and coalescing.

Under a different circumstances during operation, the liquid entering nozzles 50 from outer regions of the liquid delivery channel (the left side of the figure and the right side of the figure as shown in FIG. 5) can have a smaller lateral flow component (represented by arrow 114) when compared to the lateral flow component (represented by arrows 112) of liquid entering nozzles 50 from the inner regions of the liquid delivery channel 47 (the center area of the figure as shown in FIG. 5). As the smaller lateral flow components are created in outer regions of the liquid delivery channel, the liquid filaments 52 are caused to be angled slightly away from each other when the liquid filaments 52 are emitted through nozzles 50. This causes the drop trajectory of large drops 56 to diverge relative to each other at an angle such that the large drops 56 never contact each other and coalesce to form combined larger drops 100.

The present invention is directed at reducing (or even eliminating) the likelihood of one of more of these conditions occurring by controlling the directionality of the liquid jets that are emitted from nozzles 50. Example embodiments of the present invention include directionality control of liquid jets or drops using a liquid jet directionality control mechanism. Example embodiments of the liquid jet directionality control mechanism include asymmetric energy application device configurations as described with reference to FIGS. 6-10, nozzle geometry configurations as described with reference to FIGS. 11 and 12, or liquid delivery channel geometry configurations as described with reference to FIGS. 13 and 14.

Referring back to FIGS. 1 through 4B and to FIGS. 6 through 14, generally described, a printhead of the present invention includes a first nozzle 50 and a second nozzle 50 spaced apart from the first nozzle 50. A liquid delivery channel 47 is in liquid communication with the first nozzle 50 and the second nozzle 50 to provide liquid that is under pressure sufficient to cause a first liquid jet 52 to be emitted from the first nozzle 50 at a first angle and a second liquid jet 52 to be emitted from the second nozzle 50 at a second angle. The first angle and the second angle are nonparallel relative to each other. A drop forming mechanism 28 is configured to from large volume drops and small volume drops from the first liquid jet 52 emitted from the first nozzle 50 and the second liquid jet 52 emitted from the second nozzle 50. A liquid jet directionality control mechanism 116 is configured to control the first angle of the first liquid jet 52 and the second angle of the second liquid jet 52 relative to each other such that large volume drops formed from the first liquid jet 52 and large volume drops formed from the second liquid jet 52 contact each other or coalesce while the small volume drops formed from the first liquid jet 52 and small volume drops formed from the second liquid jet 52 do not contact each other or coalesce. The liquid jet directionality control mechanism 116 can be associated with, for example, located in or near, the first nozzle, the second nozzle, the liquid delivery channel, or combinations thereof.

The liquid jet directionality control mechanism 116 can be configured to apply more energy to one side of the first liquid jet than the other side of the first liquid jet and can be configured to apply more energy to one side of the second liquid jet than the other side of the second liquid jet. The sides of the first liquid jet and the second liquid jet that receive more energy from the directionality control mechanism 116 can be adjacent to each other.

Referring to FIGS. 6 through 10, schematic views of example embodiments of the present invention are shown. Liquid jet directionality control mechanism 116 includes a first heater 118 positioned adjacent to the first nozzle 50 and a second heater 120 positioned adjacent to the second nozzle 50. Controller 38 is configured to actuate the first heater 118 and the second heater 120 simultaneously. When liquid jet directionality control mechanism 116 includes a heater, drop forming mechanism 28 and liquid jet directionality control mechanism 116 can be the same mechanism.

Figure 6:
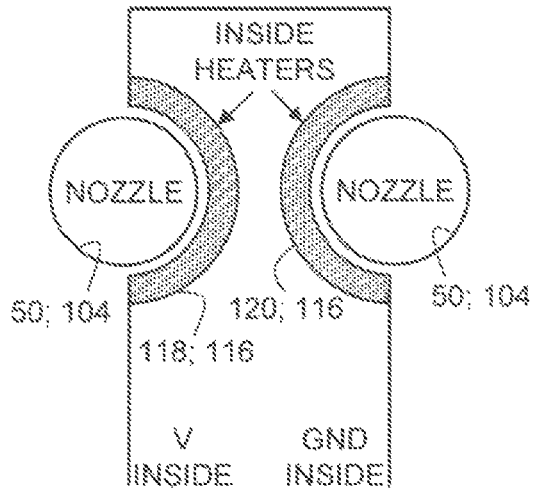
FIG. 6 is a schematic view of an example embodiment of the present invention.
Figure 7:
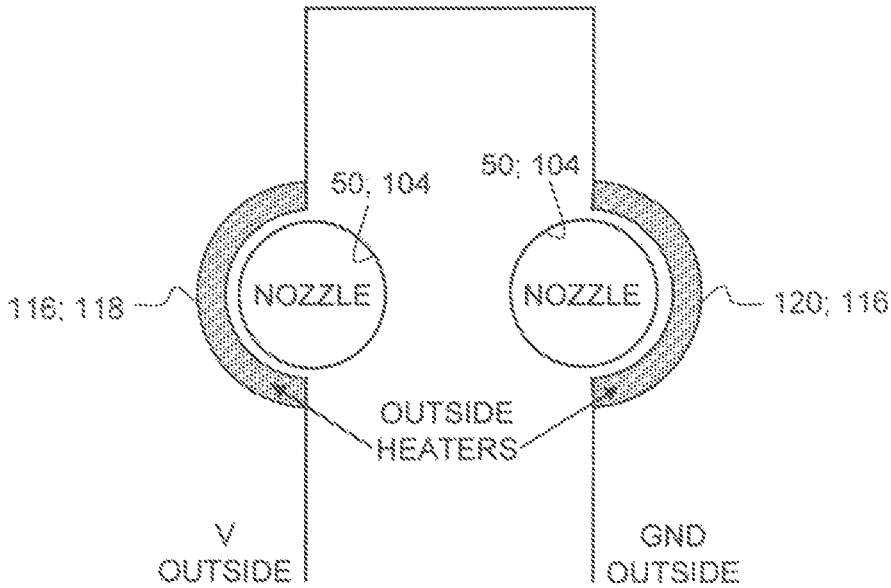
FIG. 7 is a schematic view of another example embodiment of the present invention.
Figure 8:
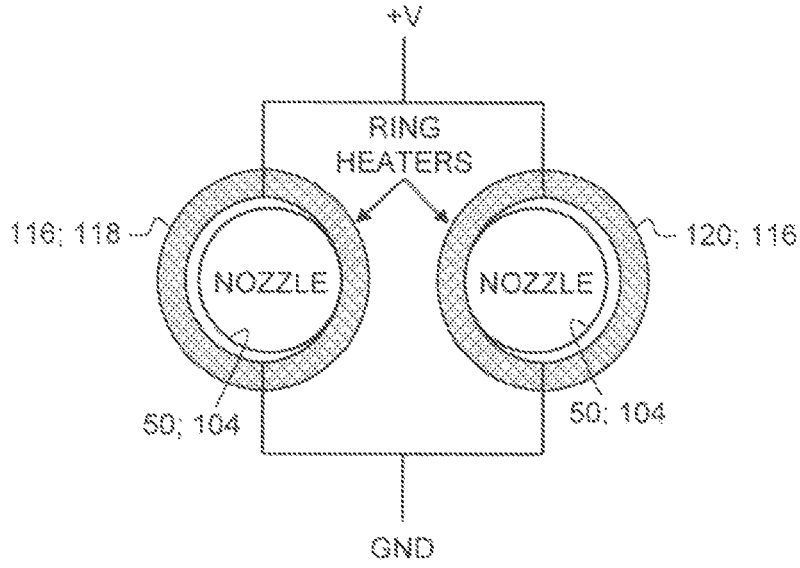
FIG. 8 is a schematic view of another example embodiment of the present invention.

First heater 118 and second heater 120 can include a single selectively actuated section, as shown in FIGS. 6, 7, and 8. In FIG. 6, first heater 118 and second heater 120 are positioned adjacent to each other in between first and second nozzles 50 and in electrical communication with each other. This heater configuration is typically used in example embodiments in which nozzles 50 are positioned close enough to each other such that, when large drops 56 are formed from nozzles 50, large drops 56 contact each other and coalesce without being influenced by an outside source. First and second heaters 118 and 120 are simultaneously actuatable by controller 38 to change the angles at which liquid jets 52 are emitted so that small drops 54 do not contact each other. For example, heaters 118 and 120 can either cause liquid jet 52 to become parallel to each other or slightly diverge from each other.

In FIG. 7, first nozzle 50 and second nozzle 50 are positioned between first heater 118 and second heater 120. First heater 118 and second heater 120 are in electrical communication with each other. This heater configuration is typically used in example embodiments in which nozzles 50 are positioned far enough apart from each other such that small drops 54 do not contact each other. Unfortunately, when large drops 56 are formed from nozzles 50, large drops 56 typically do not contact each other and coalesce without being influenced by an outside source. First and second heaters 118 and 120 are simultaneously actuatable by controller 38 to change the angles at which liquid jets 52 are emitted so that large drops 56 contact each other and coalesce.

In FIG. 8, first heater 118 is a first ring heater that is eccentrically positioned around first nozzle 50. Second heater 120 is a second ring heater eccentrically positioned around second nozzle 50. First heater 118 and second heater 120 are in electrical communication with each other. The portions of the first ring heater and the second ring heater that are positioned adjacent to each other, the portions in between the nozzles, are closer to the first and second nozzles than the portions of the first and second ring heaters that are positioned on opposite sides of the first and second nozzles. As described above with reference to FIG. 6, this heater configuration is typically used in example embodiments in which nozzles 50 are positioned close enough to each other such that, when large drops 56 are formed from nozzles 50, large drops 56 contact each other and coalesce without being influenced by an outside source. Alternatively, by placing the outside portions of the first and second ring heaters closer to nozzles 50 an example embodiment is created that is similar in function to the embodiment described with reference to FIG. 7.

Figure 9:
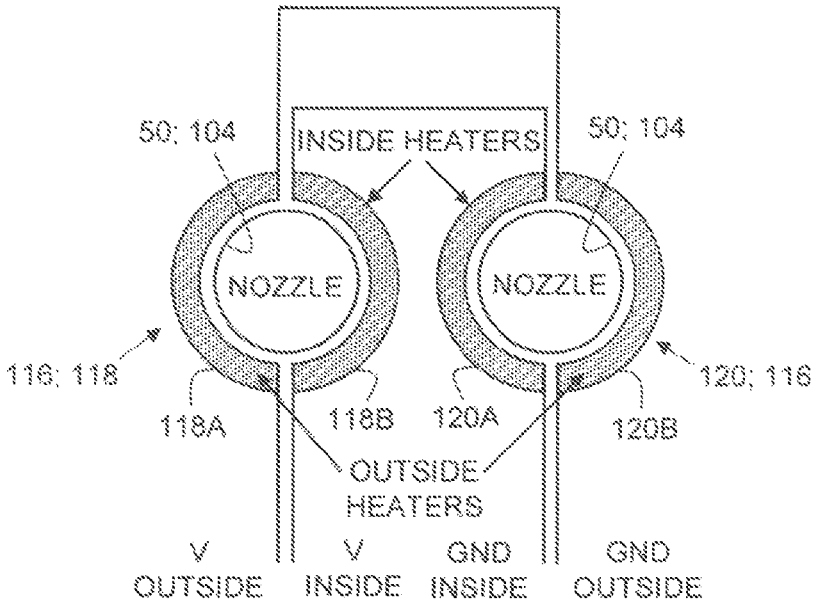
FIG. 9 is a schematic view of another example embodiment of the present invention.
Figure 10:
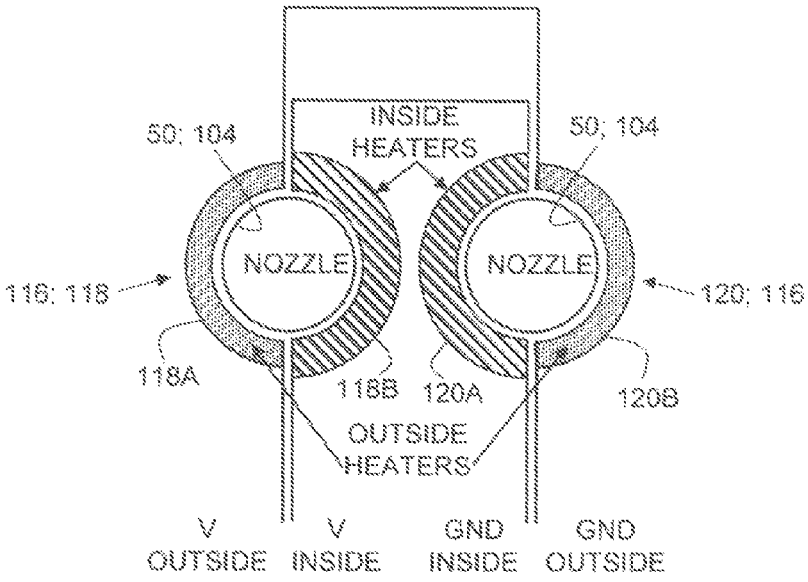
FIG. 10 is a schematic view of another example embodiment of the present invention.

Alternatively, first heater 118 and second heater 120 can be a split heater including a first selectively actuatable section 118A, 120A and a second selectively actuatable section 118B and 120B, as shown in FIGS. 9 and 10. Heater sections 118A and 120A are electrically configured to be driven independently of heater sections 118B and 120B, respectively.

In FIGS. 9 and 10, first heater 118 is a first split heater including a first selectively actuatable section 118A positioned on one side of first nozzle 50 and a second selectively actuatable section 118B positioned on the other side of first nozzle 50. Second heater 120 is a second split heater including a third selectively actuatable section 120A positioned on one side of second nozzle 50 and a fourth selectively actuatable section 120B positioned on the other side of second nozzle 50.

The third selectively actuatable section 120A of second split heater 120 is positioned adjacent to the second selectively actuatable section 118B of first split heater 118. These heater sections are in electrical communication with each other. Controller 38 is configured to actuate third selectively actuatable section 120A of second split heater 120 and second selectively actuatable section 118B of the first split heater simultaneously. Additionally, fourth selectively actuatable section 120B of second split heater 120 is positioned opposite the first selectively actuatable section 118A of first split heater 118 such that nozzles 50 are located between these heater sections. These heater sections are in electrical communication with each other. Controller 38 is also configured to actuate fourth selectively actuatable section 120B of second split heater 120 and first selectively actuatable section 118A of the first split heater simultaneously. Depending on which split heater pair (118A, 120B or 118B, 120A), the directionality of liquid jets ejected from each nozzle is controlled such that the liquid jets either converge, remain substantially parallel, or diverge from each other.

In FIG. 10, first split heater 118 and second split heater 120 are asymmetrically configured such that the third selectively actuatable section 120A of the second split heater 120 and the second selectively actuatable section 118B of the first split heater 118 apply more energy to the first and second liquid jets than the fourth selectively actuatable section 120B of the second split heater 120 and the first selectively actuatable section 118A of the first split heater 118.

This can be accomplished in several ways. For example, the sizes (width, height, or length) or resistivity of heater sections 118B and 120A can be different when compared to the sizes or resistivity of heater sections 118A and 120B, shown in FIG. 10 using larger heater sections 118B and 120A with a bold cross hatch pattern. Alternatively, heater sections 118A and 120B can be positioned farther away from nozzles 50 when compared to position of heater sections 118B and 120A.

Referring back to FIGS. 6-10, the electrical interconnections between first heater 118 and second heater 120 can be accomplished using conventional techniques. For example, the electrical interconnection can be made as described in U.S. Pat. No. 6,474,781, issued to Jeanmaire, on Nov. 5, 2002.

Figure 11:
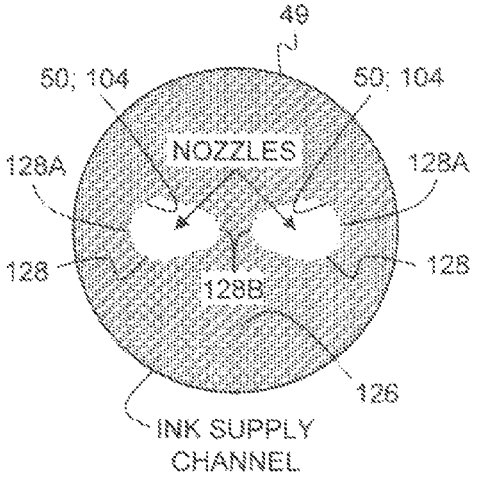
FIG. 11 is a schematic view of another example embodiment of the present invention.
Figure 12:
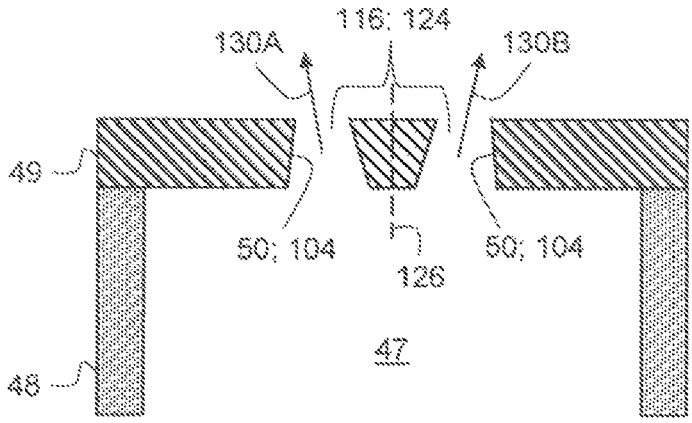
FIG. 12 is a schematic view of another example embodiment of the present invention.

Referring to FIGS. 11 and 12, schematic views of example embodiments of the present invention are shown. Liquid jet directionality control mechanism 116 includes providing the first nozzle 50 and the second nozzle 50 with a nozzle geometry 122 as shown in FIGS. 11 and 124 as shown in FIG. 12 that is shaped to control the first angle of the first liquid jet 52 and the second angle of the second liquid jet 52 relative to each other such that large volume drops 56 formed from the first liquid jet 52 and large volume drops 56 formed from the second liquid jet 52 contact each other or coalesce while the small volume drops 54 formed from the first liquid jet and small volume drops 54 formed from the second liquid jet do not contact each other or coalesce.

In FIGS. 11 and 12, nozzle cluster 104 includes two nozzles 50 although nozzle cluster 104 can include more than two nozzles, for example, three or four nozzles as described below. Nozzle cluster 104 includes a center of symmetry 126 extending into and out of FIG. 11 and as shown in FIG. 12. First and second nozzles 50 are positioned symmetrically relative to the center of symmetry 126 of the nozzle cluster 104. Alternatively, first and second nozzles 50 do not have to be positioned symmetrically about the center of symmetry 126 of the nozzle cluster 104. In these situations, first nozzle 50 and second nozzle 50 are individually and uniquely shaped relative to each other in order to accomplish liquid jet directionality control.

Referring to FIG. 11, each nozzle 50 is asymmetrically shaped relative to a centerline of each nozzle. Nozzles 50 each include non-circular shapes 128 designed to cause the jets to remain substantially parallel or diverge slightly from each other after the jets are ejected through the first and second nozzles 50. As shown in FIG. 11, non-circular shapes 128 are generally oblong with the wider ends 128A opposite each other while the narrower ends 128B are adjacent to each other. When nozzles 50 are positioned far enough apart from each other such that large drops 56 do not contact each other, nozzles 50 can be shaped to cause the liquid jets to converge.

In FIG. 12, each nozzle 50 includes a center axis 130A, 130B. First and second nozzles 50 are positioned relative to each other such that the center axis 130A of the first nozzle 50 is not parallel to the center axis 130B of the second nozzle 50. Depending on the degree of non-parallelism, nozzles 50 can be shaped such that the jets remain substantially parallel or diverge from each other after the jets are ejected through the first and second nozzle bores. Alternatively, nozzles 50 can be shaped to cause the jets to converge when, for example, nozzles 50 are positioned far enough apart from each other such that large drops 56 do not contact each other.

Figure 13:
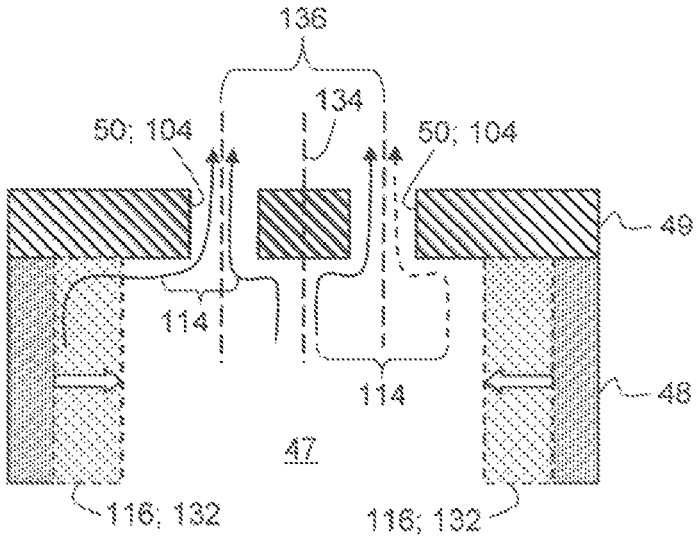
FIG. 13 is a schematic view of another example embodiment of the present invention.
Figure 14:
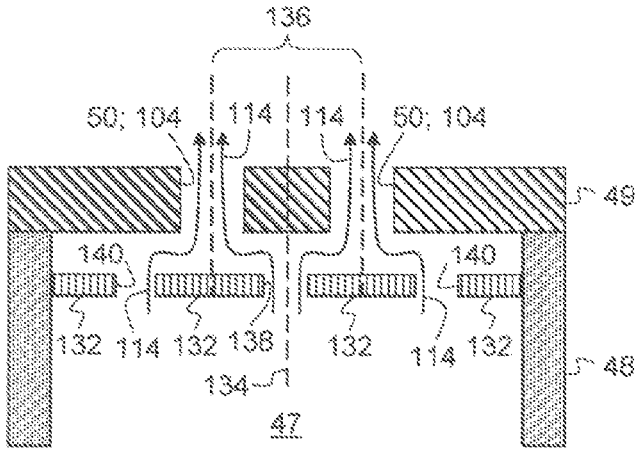
FIG. 14 is a schematic view of another example embodiment of the present invention.

Referring to FIGS. 13 and 14, schematic views of example embodiments of the present invention are shown. Liquid jet directionality control mechanism 116 includes a wall(s) 132 of the liquid delivery channel 47 positioned relative to the first nozzle 50 and the second nozzle 50 to control the lateral flow component (represented by arrow 114) in the liquid in the liquid delivery channel to control the first angle of the first liquid jet and the second angle of the second liquid relative to each other such that large volume drops formed from the first liquid jet and large volume drops formed from the second liquid jet contact each other or coalesce while the small volume drops formed from the first liquid jet and small volume drops formed from the second liquid jet do not contact each other or coalesce.

Referring to FIG. 13, nozzle cluster 104 includes two nozzles 50 positioned about a center axis 134 of the nozzle cluster 104. Walls 132 are positioned parallel to the center axis 134 of the nozzle cluster 104. Walls 132 are also positioned relative to first and second nozzles 50 to control the lateral flow component (represented by arrows 114) of the liquid in the liquid delivery channel 47 as the liquid enters nozzles 50. In FIG. 13, walls 132 have been positioned relative to nozzles 50 so that the lateral flow component (represented by arrows 114) of the liquid is symmetric about a center line 136 of each nozzle 50 as the liquid enters nozzles 50.

Referring to FIG. 14, wall 132 is positioned perpendicular to center axis 134 of nozzle cluster 104. Wall 132 includes a through hole 138 positioned between the first and second nozzles 50 to control the lateral flow component (represented by arrows 114) of the liquid in the liquid delivery channel 47 as the liquid enters nozzles 50. Wall 132 also includes through holes 140 positioned on opposite sides of first and second nozzles 50 to control the lateral flow component (represented by arrows 114) of the liquid in the liquid delivery channel 47 as the liquid enters nozzles 50. The inclusion of through holes 138, 140 causes the lateral flow component (represented by arrows 114) of the liquid to be symmetric about center line 136 of each nozzle 50 as the liquid enters nozzles 50.

Referring to FIGS. 15-18, schematic views of example embodiments of nozzle cluster arrangements are shown. The relative positioning of each nozzle cluster 104 to a gas flow 62 of a gas flow deflection mechanism 60 is also included in FIGS. 15-18.

Figure 15:
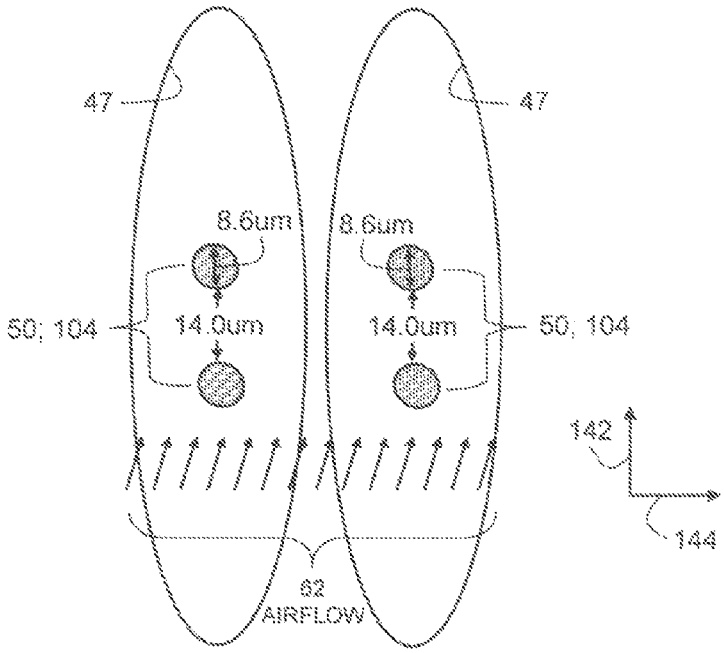
FIGS. 15-18 are schematic views of example embodiments of nozzle cluster arrangements.
Figure 16:
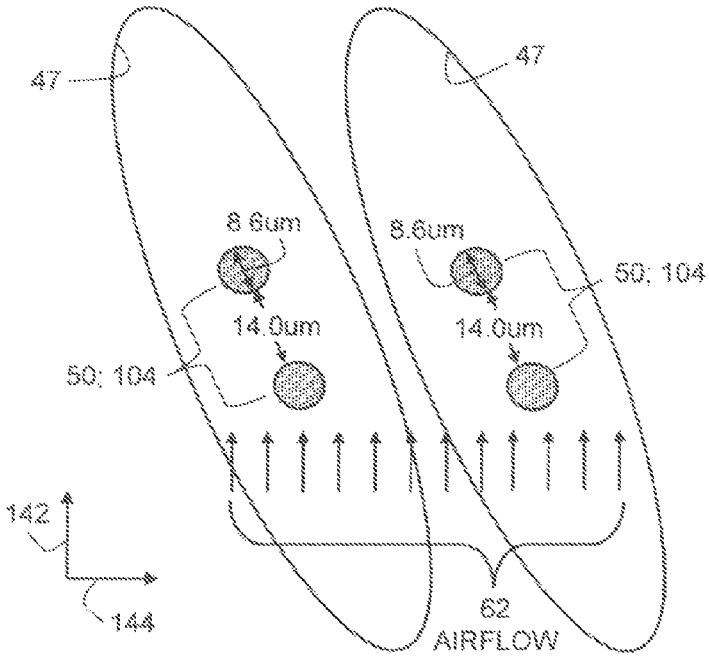

Referring to FIGS. 15 and 16, each nozzle cluster 104 includes two nozzles 50 fed by a portion of delivery channel 47. In FIG. 15, the nozzles 50 of each nozzle cluster 104 are aligned relative to each other in a first direction (represented by arrow 142) and a second direction (represented by arrow 144). Additionally, the nozzles 50 of nozzle cluster 104 and the gas flow 62 of the gas flow deflection mechanism 60 are positioned at a non-perpendicular, non-parallel angle relative to each other and the first and second directions. The gas flow 62 of the gas flow deflection mechanism 60 is also positioned to interact at a perpendicular angle relative to the drops formed from each nozzle 50 (the drops traveling into or out of FIG. 15). This gas flow nozzle relationship helps to ensure that combined large drops 100 and small drops 54 are satisfactorily deflected without colliding with each other.

In FIG. 16, the nozzles 50 of each nozzle cluster 104 are offset relative to each other in a first direction (represented by arrow 142) and aligned relative to each other in a second direction (represented by arrow 144). Additionally, the nozzles 50 of nozzle cluster 104 and the gas flow 62 of the gas flow deflection mechanism 60 are positioned at a non-perpendicular, non-parallel angle relative to each other, at a parallel angle relative to the first direction, and at a perpendicular angle relative to the second direction. The gas flow 62 of the gas flow deflection mechanism 60 is also positioned to interact at a perpendicular angle relative to the drops formed from each nozzle 50 (the drops traveling into or out of FIG. 16). This gas flow nozzle relationship helps to ensure that combined large drops 100 and small drops 54 are satisfactorily deflected without colliding with each other.

Figure 17:
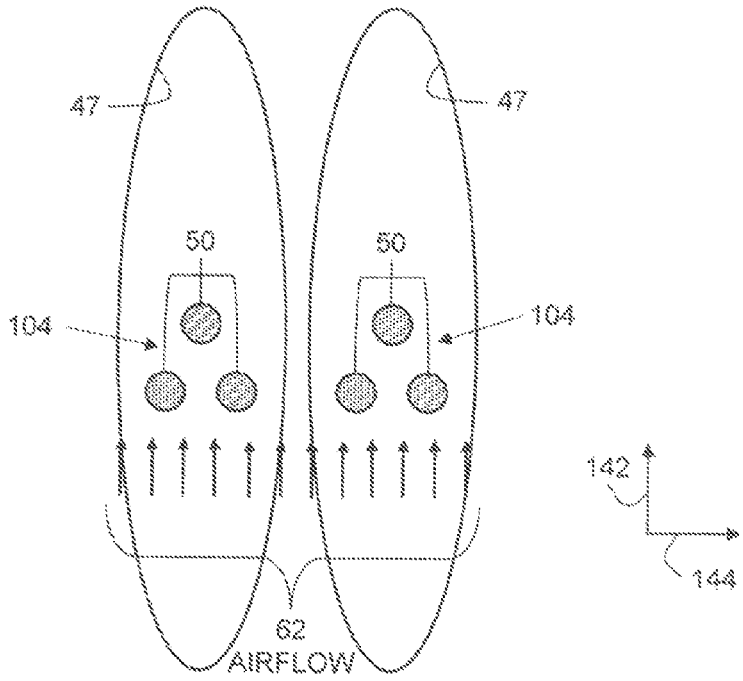

Referring to FIG. 17, each nozzle cluster 104 includes three nozzles 50 fed by a portion of delivery channel 47. The nozzles 50 of each nozzle cluster 104 are offset relative to each other in a first direction (represented by arrow 142) and aligned relative to each other in a second direction (represented by arrow 144). Additionally, the nozzles 50 of nozzle cluster 104 and the gas flow 62 of the gas flow deflection mechanism 60 are positioned at a non-perpendicular, non-parallel angle relative to each other, at a parallel angle relative to the first direction, and at a perpendicular angle relative to the second direction. The gas flow 62 of the gas flow deflection mechanism 60 is also positioned to interact at a perpendicular angle relative to the drops formed from each nozzle 50 (the drops traveling into or out of FIG. 17). This gas flow nozzle relationship helps to ensure that combined large drops 100 and small drops 54 are satisfactorily deflected without colliding with each other.

Figure 18:
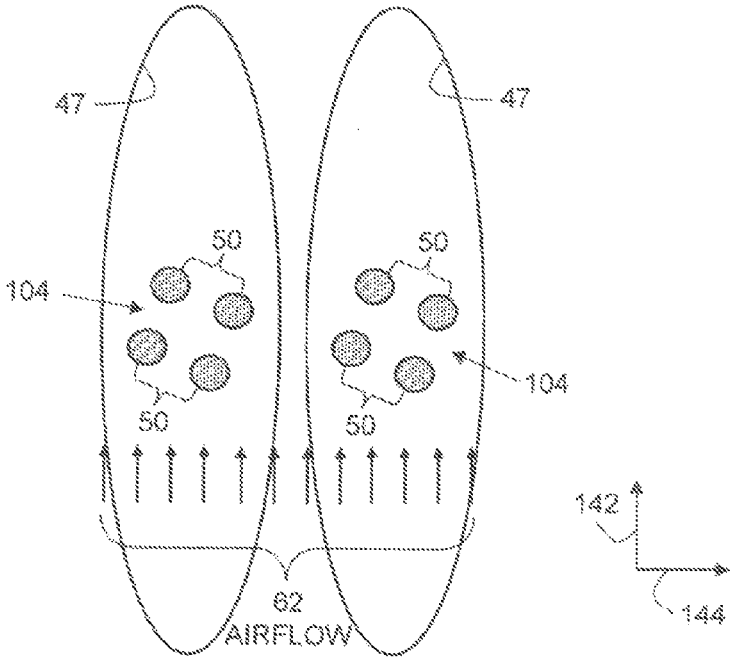

Referring to FIG. 18, each nozzle cluster 104 includes four nozzles 50 fed by a portion of delivery channel 47. The nozzles 50 of each nozzle cluster 104 are offset relative to each other in a first direction (represented by arrow 142) and offset relative to each other in a second direction (represented by arrow 144). Additionally, the nozzles 50 of nozzle cluster 104 and the gas flow 62 of the gas flow deflection mechanism 60 are positioned at a non-perpendicular, non-parallel angle relative to each other, at a parallel angle relative to the first direction, and at a perpendicular angle relative to the second direction. The gas flow 62 of the gas flow deflection mechanism 60 is also positioned to interact at a perpendicular angle relative to the drops formed from each nozzle 50 (the drops traveling into or out of FIG. 18). This gas flow nozzle relationship helps to ensure that combined large drops 100 and small drops 54 are satisfactorily deflected without colliding with each other.

Referring back to FIGS. 1 through 4B and 6 through 14, catcher 42 is positioned spaced apart from the first and second nozzles 50 creating deflection zone 64 (as deflection is one form of drop selection, the deflection zone can also be referred to as a selection zone). Catcher 42 is positioned to collect one of the small volume drops 54 and the combined large volume drops 100. In some example embodiments of the present invention, the small volume drops 54 formed from the first liquid jet 52 and the small volume drops 52 formed from the second liquid jet 52 do not contact each other or coalesce before these drops travel through the deflection zone and beyond catcher 42. In these embodiments, small drops 54 maintain their size and volume and either contact the print media or are collected by catcher 42.

In other example embodiments of the present invention, the small volume drops 54 formed from the first and second liquid jets 52 do not contact each other or coalesce before these drops travel through the deflection zone (also referred to as a selection zone). However, these drops can contact each other and coalesce before traveling beyond catcher 42. In these embodiments, small drops 54, the size and volume of the small drop changes prior to the combined small drop contacting the print media or being collected by catcher 42.

As described above, drop selection is accomplished using gas flow drop deflection. Drop selection can be accomplished using other techniques. For example, drop deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000. Drop deflection can also be accomplished using conventional electrostatic deflection methods in which drops are selectively changed and deflected using deflection plates as described in, for example, U.S. Pat. No. 3,373,437, issued to Sweet et al. on Mar. 12, 1968; U.S. Pat. No. 3,878,519, issued to Eaton on Apr. 15, 1975; and U.S. Pat. No. 4,638,328, issued to Drake et al. on Jan. 20, 1987. Alternatively, drop selection can be accomplished using a drop contact catcher, for example, the catcher described in U.S. Pat. No. 3,893,623, issued to Toupin on Jul. 8, 1975.

The example embodiments described above can be implemented individually (by themselves) or in combination with each other to obtain the desired performance. Accordingly, a printhead or jetting module of the present invention can include more than one liquid jet directionality control mechanism 116. For example, the nozzle geometries of FIGS. 11-14 can additionally employ jet control mechanisms 116 including heaters as described in reference to FIGS. 6-10 in order to have enhanced control over the directionality of the liquid jets or drops ejected through the nozzles.

The invention has been described in detail with particular reference to certain preferred embodiments thereof, but it will be understood that variations and modifications can be effected within the scope of the invention.

PARTS LIST

20 continuous printing system
22 image source
24 image processing unit
26 mechanism control circuits
28 device
30 printhead
32 recording medium
34 recording medium transport system
36 recording medium transport control system
38 controller
40 reservoir
42 catcher
44 recycling unit
46 pressure regulator
47 liquid delivery channel
48 jetting module
49 nozzle plate
50 plurality of nozzles
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
96 wall
100 combined large drop
102 device stimulation waveform
104 nozzle cluster
106 activation
108 activation
110 combined small drop
112 arrow
114 arrow

116 liquid jet directionality control mechanism
118 first heater
118A first selectively actuatable section
118B second selectively actuatable section
120 second heater
120A first selectively actuatable section
120B second selectively actuatable section
122 nozzle geometry
126 center of symmetry
128 non-circular shape
128A end
128B end
130 center axis
130A center axis
130B center axis
132 walls
134 center axis
136 center line
138 hole
140 hole
142 arrow
144 arrow

The invention claimed is:

1. A printhead comprising:

a nozzle cluster including a first nozzle and a second nozzle spaced apart from the first nozzle, the first and second nozzles having a nozzle geometry;

a liquid delivery channel in liquid communication with the nozzle cluster to provide liquid that is under pressure sufficient to cause a first liquid jet to be emitted from the first nozzle at a first angle and a second liquid jet to be emitted from the second nozzle, the first angle and the second angle being nonparallel relative to each other; and a drop forming mechanism configured to from large volume drops and small volume drops from the first liquid jet emitted from the first nozzle and the second liquid jet emitted from the second nozzle, the nozzle geometry of the first nozzle and the second nozzle being shaped to control the first angle of the first liquid jet and the second angle of the second liquid jet relative to each other such that large volume drops formed from the first liquid jet and large volume drops formed from the second liquid jet contact each other or coalesce while the small volume drops formed from the first liquid jet and small volume drops formed from the second liquid jet do not contact each other or coalesce.

2. The printhead of claim 1, the nozzle cluster having a center of symmetry, wherein the first and second nozzles are positioned symmetrically relative to the center of symmetry of the nozzle cluster.

3. The printhead of claim 2, the first nozzle having a center axis, the second nozzle having a center axis, wherein the first and second nozzles are positioned relative to each other such that the center axis of the first nozzle is not parallel to the center axis of the second nozzle.

4. The printhead of claim 2, wherein the first nozzle has a non-circular shape and the second nozzle has a non-circular shape.

5. The printhead of claim 1, the first nozzle having a center axis, the second nozzle having a center axis, wherein the first and second nozzles are positioned relative to each other such that the center axis of the first nozzle is not parallel to the center axis of the second nozzle.

6. The printhead of claim 1, wherein the first nozzle has a non-circular shape and the second nozzle has a non-circular shape.

7. A method of printing comprising:

providing a nozzle cluster including a first nozzle and a second nozzle spaced apart from the first nozzle, the first and second nozzles having a nozzle geometry;

providing liquid under pressure sufficient to cause a first liquid jet to be emitted from the first nozzle at a first angle and a second liquid jet to be 15 emitted from the second nozzle at a second angle, the first angle and the second angle being nonparallel relative to each other;

forming large volume drops and small volume drops from the first liquid jet emitted from the first nozzle and the second liquid jet emitted from the second nozzle by actuating a drop forming mechanism; and controlling the first angle of the first liquid jet and the second angle of the second liquid jet relative to each other such that large volume drops formed from the first liquid jet and large volume drops formed from the second liquid jet contact each other or coalesce while the small volume drops formed from the first liquid jet and small volume drops formed from the second liquid jet do not contact each other or coalesce using the shape of the nozzle geometry of the first nozzle and the second nozzle.

* * * * *